US010202804B2

(12) United States Patent
Prasad

(10) Patent No.: US 10,202,804 B2
(45) Date of Patent: Feb. 12, 2019

(54) FENCE OPENING AND FENCE SYSTEM

(71) Applicant: Rajiv R. Prasad, Hopatcong, NJ (US)

(72) Inventor: Rajiv R. Prasad, Hopatcong, NJ (US)

( * ) Notice: Subject to any disclaimer, the term of this patent is extended or adjusted under 35 U.S.C. 154(b) by 299 days.

(21) Appl. No.: 15/235,211

(22) Filed: Aug. 12, 2016

(65) Prior Publication Data

US 2018/0044983 A1 Feb. 15, 2018

(51) Int. Cl.

| | |
|---|---|
| ***E06B 11/02*** | (2006.01) |
| ***E06B 11/04*** | (2006.01) |
| ***E04H 17/04*** | (2006.01) |
| ***E04H 17/22*** | (2006.01) |
| ***E04H 17/16*** | (2006.01) |

(52) U.S. Cl.

CPC ..... *E06B 11/021* (2013.01); *E04H 17/04* (2013.01); *E04H 17/163* (2013.01); *E04H 17/22* (2013.01); *E06B 11/022* (2013.01); *E06B 11/028* (2013.01); *E06B 11/04* (2013.01)

(58) Field of Classification Search

CPC .... E06B 11/022; E06B 11/021; E06B 11/028; E06B 11/04; E04H 17/04; E04H 17/22; E04H 17/163

USPC ..... 256/24, 65.14, 67, 73, DIG. 5; 248/157, 248/354.1, 539, 188.5

See application file for complete search history.

(56) References Cited

U.S. PATENT DOCUMENTS 3,740,022 A * 6/1973 DiGiovanni ..... E04F 11/1812 256/24
4,791,757 A 12/1988 Orlando
5,581,940 A 12/1996 Peterson
5,636,482 A * 6/1997 Klager ..... E04H 12/2292 256/DIG. 5
5,720,132 A 2/1998 Renner
5,921,027 A 7/1999 Siebenahler
6,464,209 B2 6/2002 Meis
6,481,156 B1 11/2002 Richmond
7,213,368 B1 5/2007 Eliasen
7,458,140 B2 * 12/2008 Harris ..... E04H 17/066 256/24
8,096,727 B2 1/2012 Parenti
9,066,493 B2 * 6/2015 Barzani ..... A63K 3/046
2007/0210295 A1 * 9/2007 Smith ..... E04H 17/20 256/65.14
2010/0171085 A1 * 7/2010 Webster, IV ..... E01F 15/0461 256/65.14
2012/0066997 A1 * 3/2012 Hodgson ..... E04H 17/1404 52/588.1
2014/0339486 A1 * 11/2014 Sharp ..... E01F 15/0476 256/65.14
2014/0374682 A1 * 12/2014 Chilton ..... E04G 5/14 256/68

(Continued)

*Primary Examiner* — Amber R Anderson
*Assistant Examiner* — Nahid Amiri
(74) *Attorney, Agent, or Firm* — Baldini Law, LLC

(57) ABSTRACT

Yard fences and land enclosures typically have a gate or other door structure that requires some sort of hinge, latch and looks different in overall appearance from the rest of the structure (just as the front door of a house appears different from the outer wall). Presented here is a simple mechanism by which any part of commonly used fences can be implemented as a fence opening. When closed, it appears as a continuous fence. However, when implementing the teaching herein, the space between any two fence posts can become a fence opening.

7 Claims, 16 Drawing Sheets

(56) References Cited

U.S. PATENT DOCUMENTS

| | | | | |
|---|---|---|---|---|
| 2015/0101267 | A1* | 4/2015 | Smith | E02D 5/28 52/154 |
| 2015/0264890 | A1* | 9/2015 | Barzani | A63K 3/046 119/502 |
| 2017/0019980 | A1* | 1/2017 | Ricks | H05C 1/00 |
| 2017/0138006 | A1* | 5/2017 | Wiegel | E01F 9/646 |

* cited by examiner

FENCE OPENING AND FENCE SYSTEM

FIELD OF THE INVENTION

Yard fences and land enclosures typically have a gate or other door structure that requires some sort of hinge, latch and looks different in overall appearance from the rest of the structure (just as the front door of a house appears different from the outer wall). Presented here is a simple mechanism by which any section—post to post—of commonly used fences can be transformed into a fence opening. When closed, it appears as a continuous fence. However, when implementing the teaching herein, the space between any two fence posts can become a fence opening.

BACKGROUND

Homeowners, pet owners, and land owners all have a need to build fences for a variety of reasons around their property. For example, landowners may want to simply define the metes and bounds of their property line. Homeowners may want to add a degree of safety keeping unwanted visitors out of their property or alternatively, keeping small children within their property, or both. Pet owners may want to keep their pets confined to a given area. There are myriad reasons for wanting to build a fence.

A fence, as an obstruction keeping things in or out of the defined area also prevents wanted ingress or egress through the fence line. There are many known methods for providing ingress and egress through a fence, such as conventional doors and/or gates.

However, building a door or gate through a fence can have various drawbacks. Firstly, the fence generally appears differently where the door or gate is located. Second, the door or gate can be cumbersome to build, maintain and use. Third, the door or gate may not limit ingress or egress to just those desired instances and can actually function as a hole in the fence. A door or gate may be difficult to install, expensive, made of materials very different than the fence within which it is to function, and may easily break requiring difficult and expensive repair or replacement.

There have been many attempts to construct a better fence door or gate. For example, U.S. Pat. No. 4,791,757 titled ROLLER GATE OPENER, discloses, "a garage door opener is mounted on a fence to move a roller gate horizontally across a fence opening. A trolley connected to the gate slides on a horizontal guide which is mounted on the fence, extending between the fence and the gate in its open position."

In another example, U.S. Pat. No. 5,581,940 titled DOG DOOR, discloses, "a two way animal door adapted to be installed in an existing door to allow two way travel of household pets. More specifically, the present invention pertains to a frame which is inserted into a rectangular aperture formed within an existing door. The frame carries a centrally located post which serves to divide the frame into two equal portions. Within the frame are 380, position a first and a second door. The first door is openable only in one direction, while the second door is openable only the opposite direction. Each of the doors is mounted to the surrounding frame by way of adjustable spring biased hinges. The various components of the present invention and the manner in which they interrelate will be described in greater detail hereinafter."

In another example, U.S. Pat. No. 5,720,132 titled FENCE GATE OPENER WITH FLUID GRAVITY CLOSURE ASSEMBLY, discloses, "a fence gate opener with fluid gravity closure assembly having 1) a main closure gate assembly with a main gate assembly; 2) a main support base assembly operable to be connected to a ground support surface and having the main gate assembly pivotally connected thereto; 3) a fluid gravity closure assembly operably connected to the main support base assembly and the main gate assembly for pivotal movement therewith; and 4) a gate actuator treadle assembly operably connected to the main support base assembly and the main gate assembly to cause pivotal movement thereof from the opened to the closed conditions. The main closure gate assembly includes a counterbalance weight assembly being rotatable with the main gate assembly on a pivot shaft member from opened to closed conditions of the main gate assembly. The main support base assembly includes a support frame assembly having a pivotal gate support assembly connected thereto. The fluid gravity closure assembly includes a weight transfer fluid tank assembly having a sealed fluid flow system with three tank members operable to 1) have fluid flow from a first tank member to a second tank member in the opened condition; and 2) have controlled fluid flow from the second tank member to a third tank member and back to the second tank member to provide a controlled movement of the main gate assembly from the opened to the closed conditions. The gate actuator treadle assembly can be a mechanical actuator treadle assembly or a hydraulic actuator treadle assembly which can be used on irregular terrain ground support surfaces."

In another example, U.S. Pat. No. 5,921,027 titled, ADJUSTABLE GATE, discloses, "a gate for livestock having an adjustable height. The gate has one or more hinges which allow an operator to raise or lower the gate to a number of positions. The hinges are securely attached to a rigidly mounted structure and slidably support the gate. Each hinge has a spring-loaded handle which engages one of a number of holes in the gate. The spring-loaded handle can be preset in one of two positions where a first position allows the gate to be raised but not lowered and the second position allows the gate to be lowered but not raised. Once the gate is raised or lowered to the desired position, the handle is set to the first position."

In another example, U.S. Pat. No. 6,464,209 titled FENCE GATE, discloses, "a gate for positioning between a hinge post and a latch post. The gate comprises horizontally spaced-apart end members which are channel-shaped. Each of the end members has a base portion and spaced-apart side walls extending therefrom. A plurality of metal rail members are initially secured to and extend between the end members by means of pivot bolts. When the metal gate has been adjusted to conform to elevational differences between the hinge post and the latch post, the relationship of the rail members and the end members is fixed by means of screws extending through the side walls of the end members into the ends of the rail members."

In another example, U.S. Pat. No. 6,481,156 titled KENNEL DOOR APPARATUS, discloses, "a kennel door apparatus for selectively "opening" and "closing" a kennel door, the kennel door is sized to cover an opening located in a kennel wall between a kennel pen and a common kennel area for selective access thereto. A door opening attachment may be used to cover the opening in the kennel wall. The kennel door apparatus is adapted for vertical sliding door actuation. First and second opposing, channel guides are secured to opposing sides of a protective panel. A sliding door is slidably received between the wall confronting side and the panel side of the opposing channel guides. The opposing channel guides are vertically aligned and secured about an opening in the kennel wall. A cable is used to pull the sliding door between "open" and "closed" positions. A weather strip is secured to the sliding door between the opposing channel guides. The weather strip is positioned beneath the protective panel when the sliding door is in the "closed" position. The cable may be remotely actuated to selectively move more than one kennel door between "open" and "closed" positions by manual, electrical, hydraulic, or pneumatic operation."

In another example, U.S. Pat. No. 7,213,368 titled APPARATUS FOR VERTICAL SLIDING PET DOOR, discloses, a "vertical sliding pet door can be used to let pets in and out easily by themselves. The pet needs to be trained in the usage of the pet door, and it also protects the house from unwanted bugs and other creatures such as rodents, as it closes as soon as the pet gets out through pet door. A locking mechanism is also provided, which helps to keep the house secure, when the sliding pet door is not being used."

Finally, in another example, U.S. Pat. No. 8,096,727 titled RETRACTABLE POST SYSTEM, discloses, "a temporary barricade in the form of a retractable post system. In one configuration, the post is lowered into the ground, such that the top of the post is flush with the ground surface, leaving an unobtrusive configuration that one can walk over, drive over, and so forth. In another configuration, however, the post can be pulled up from the ground, and with a moderate rotational twisting motion, locked into vertical position, thereby providing a strong barrier to traffic and other situations."

None of the foregoing references, alone or in combination, teach the salient and proprietary features of the present disclosure. While there are many fence door and/or gate configurations, there remains a need for a fence opening that when closed, mimics exactly the look and feel of the rest of the fence, almost to the point that the fence opening location is undetectable, and is easy and simple to open and re-close, as well as easy and simple to install and maintain.

The present disclosure teaches several embodiments that utilize the existing fence material and fence posts wherein the fence posts are modified and installed as disclosed herein such that the fence section located at the point of such installation may be easily vertically raised and re-lowered into place and/or in an alternative embodiment, a latch lever slid upward in a configuration that releases said lever from its corresponding fence post leaving that corresponding fence post section in place in the corresponding rotating capsule hollow and allows the section to pivot around the adjacent fence post installation.

SUMMARY

The present disclosure teaches embodiments that utilize existing materials configured in such a way as to provide a fence section that mimics exactly the remaining fence sections and it is merely the configuration and installation of the adjacent fence posts that create a section of fence that can be easily, inexpensively and simply opened and re-closed without the need for expensive, wieldy and complicated hinges, latches and the like.

The present disclosure teaches preparing fence post anchors in a manner that allows either the fence post to be removed from and replaced into the post anchor by vertically lifting or replacing down; or, the fence post to rotate within a rotating capsule hollow installed within the fence post anchor; or some combination of both.

In one embodiment, the system and method disclosed herein teaches that two consecutive fence posts are installed into fence post anchors and configured in a way that allow both fence posts to be lifted vertically out of the fence post anchors allowing the entire fence section to be lifted to a predetermined height or removed altogether.

In an alternative embodiment, one fence post is installed into a fence post anchor within which a rotating capsule hollow is installed and all configured such that the fence post may rotate freely within the fence post anchor and an adjacent fence post installed into a fence post anchor configured to allow just that fence post (or a portion thereof that is raisable) to rise and disconnect from the fence post anchor to allow that fence section to rotate around the pivot created by the first fence post installation.

In yet another alternative embodiment, two consecutive fence post sections are installed and configured according to the previous paragraph such that the raisable fence post components are adjacent and when raised, create a double door effect.

The present disclosure teaches a fence section installation apparatus comprising:

- a first fence post anchor configured to contain a rotating capsule hollow;
- a rotating capsule hollow installed within said first fence post anchor;
- a second fence post anchor configured to contain a rotating capsule hollow;
- a second rotating capsule hollow installed within said second fence post anchor;
- a fence section with a first and second fence post configured to raise and lower into the corresponding installed first and second rotating capsule hollows.

The present disclosure also teaches a fence section installation apparatus as just described wherein the second fence post of said fence section further comprises a lever wherein the corresponding post and lever are configured to allow just the lever component to raise out of its corresponding rotating capsule hollow leaving behind a section of the fence post, which in turn, when so raised, allows said fence section to rotate or swing open and closed around the pivot created by the first fence post rotating within the first rotating capsule hollow installed within said first fence post anchor.

The present disclosure also teaches two consecutive fence sections each configured substantially as disclosed in the preceding paragraph such that each said second fence post of each fence section are adjacent.

BRIEF DESCRIPTION OF THE DRAWINGS

FIG. 3 depicts a typical wire fence with fence sections (5) and periodic posts (2), two of which, according to embodiments of this disclosure, have been modified to create a removable and replaceable opening with ground anchors (7) that the fence posts (2) can be lowered into and raised out of.

DETAILED DESCRIPTION

For clarity of disclosure, and not by way of limitation, the detailed description of the invention is divided into the following subsections that describe or illustrate certain features, embodiments or applications of the present invention.

Definitions

"fence section" as used herein means two consecutive fence posts of a fence length configured to support fence material and containing such fence material and may contain a top and/or bottom support for such fence material.

"fence post" as used herein means a post configured to support fence material and further configured to be installed into a fence post anchor to stabilize the fence relative to the ground.

"fence post anchor" as used herein means an anchor configured to be stabilized in the ground and further configured to receive a rotating capsule hollow that may receive a fence post to stabilize it relative to the ground and yet allow free rotation of the fence post within the fence post anchor.

"rotating capsule hollow" as used herein means an apparatus configured to be installed into a fence post anchor and further configured to allow a fence post to be inserted thus stabilizing the fence post relative to the ground but remaining free to be rotated and/or raised and lowered.

The System and Method of the Present Invention

A typical yard fence installation comprises metal fence posts that are simply pounded into the ground to a predefined depth and then metal chain link or other metal fabricated into a woven metal wire mesh are then attached to each post. The bottom of each metal post typically is pointed to facilitate getting inserted into the ground and also contain 'ears' or other device to keep the post from rotating and/or lifting back out of the ground.

In such fences, if a door or gate is desired, special allowances must be made to provide a post with hinges on one side of the fence section and a post with latches on the consecutive post of that fence section. Moreover, the typical fence posts of this door section require a different fence post installation to support the extra weight and functionality of the door or gate.

Herein is taught an apparatus and method of installing a separate, but exactly the same as the rest of the fence, fence section into specially configured fence post anchors, each configured in a manner depending on the desired ultimate functionality, that allow that fence section to now function as a door or gate. In this manner, only the extra, commonly available and inexpensive components as disclosed herein are required and the fence as a whole appears as one continuous fence.

Figure 1:
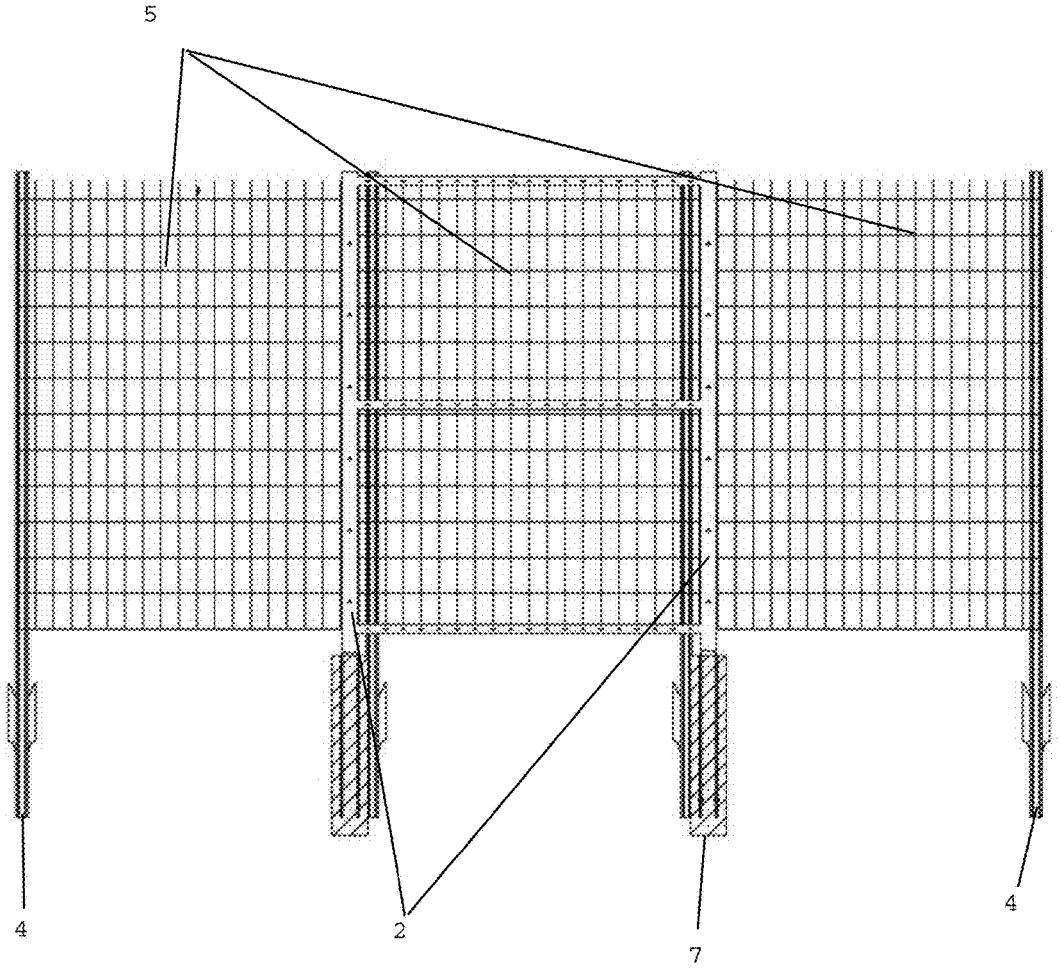
FIG. 1 depicts a head on view of one embodiment of sections of fence (5) with a fence opening as described in embodiments herein illustrating typical posts (2) with anchors (4) for securing the fence and fence opening into the ground via ground anchors (7).
Figure 2:
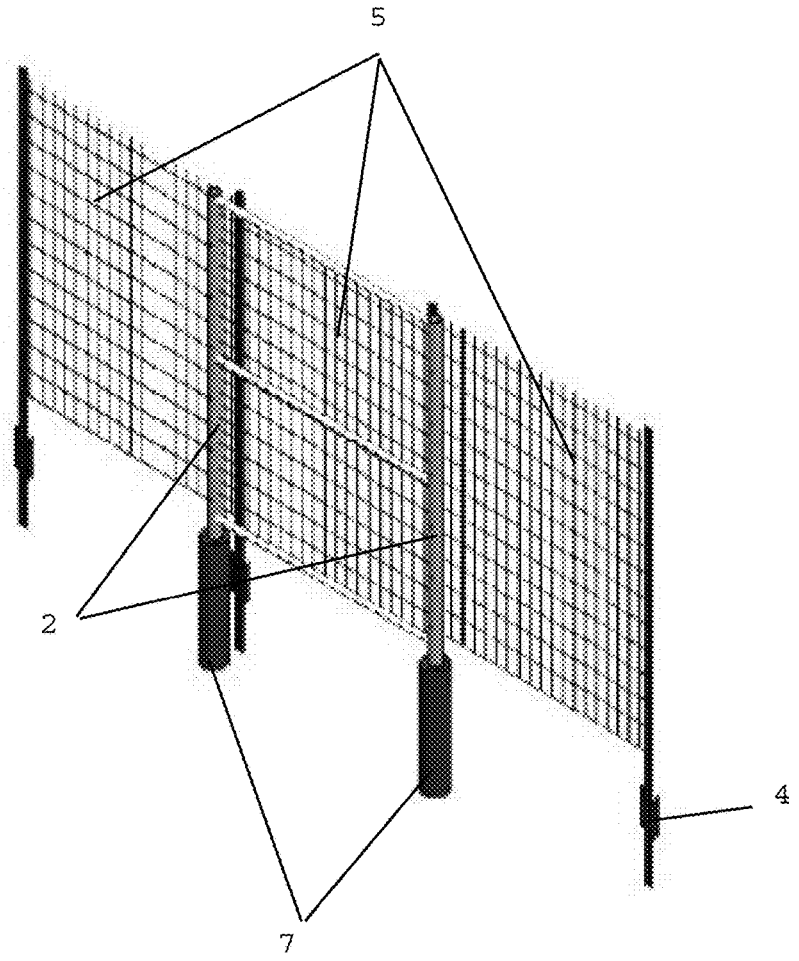
FIG. 2 depicts a perspective view of one embodiment of sections of fence (5) with a fence opening as described in embodiments herein illustrating typical posts (2) with anchors (4) for securing the fence and fence opening into the ground via ground anchors (7).
Figure 3:
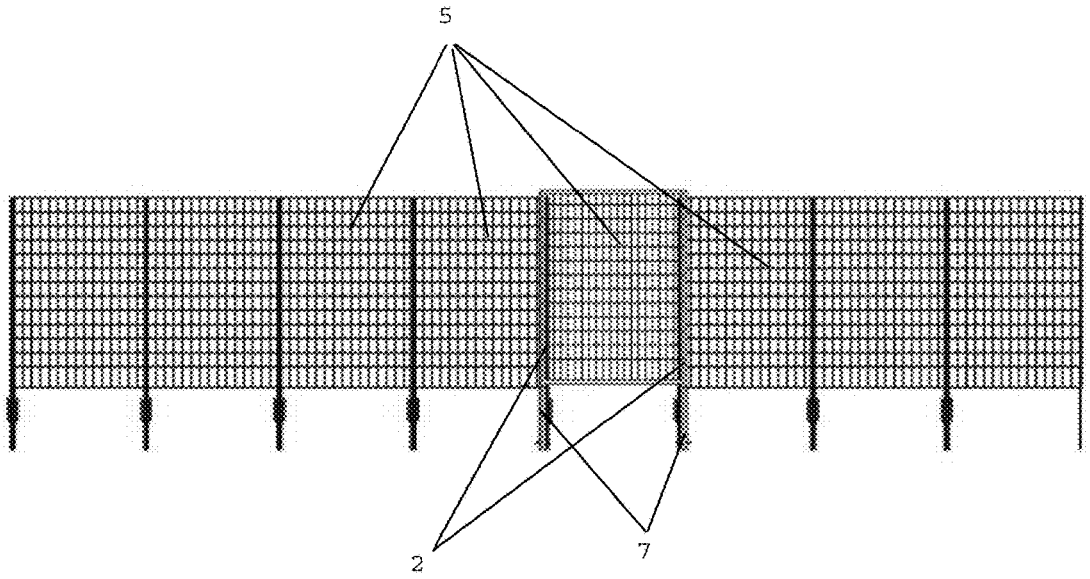
Figure 4:
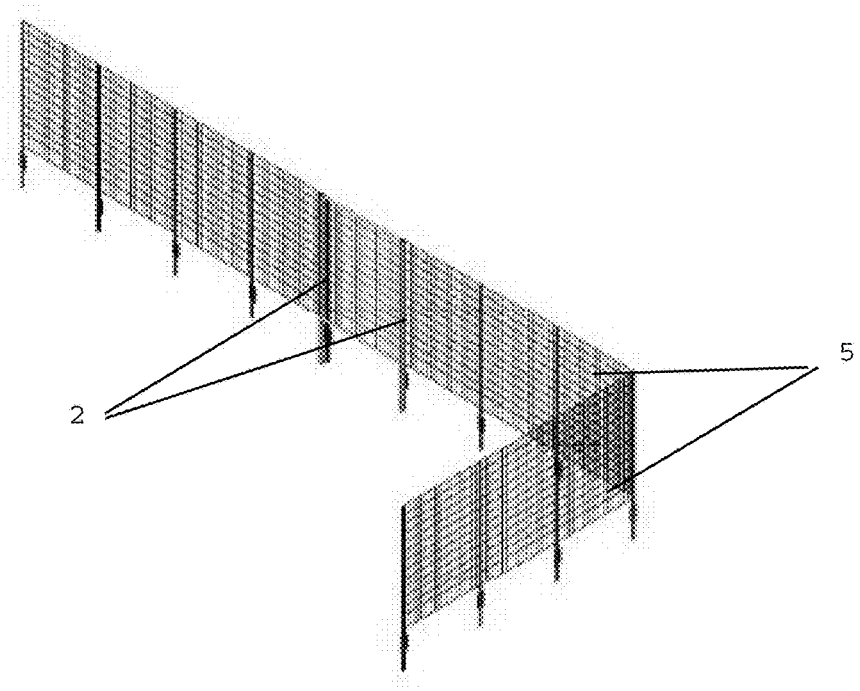
FIG. 4 depicts one embodiment of a typical wire fence with fence sections (5) and periodic posts (2), two of which, according to embodiments of this disclosure, have been modified to create a removable and replaceable opening with ground anchors (7) that the fence posts (2) can be lowered into and raised out of, here with a corner in a perspective view.
Figure 5:
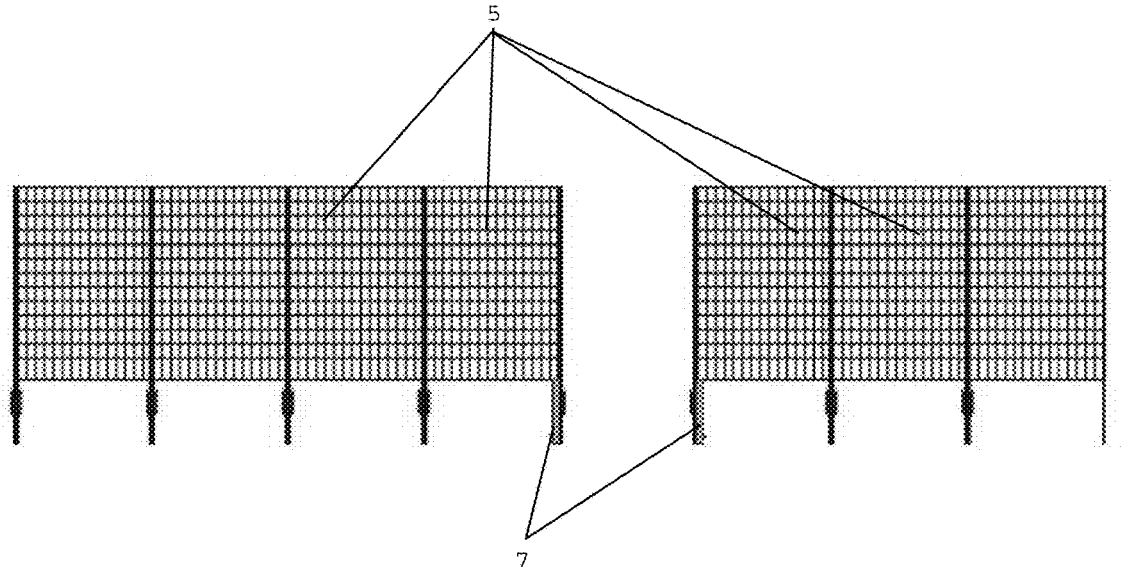
FIG. 5 depicts a typical wire fence with fence sections (5) and periodic posts, two of which, according to embodiments of this disclosure, have been modified to create a removable and replaceable opening with ground anchors (7) that the fence posts can be lowered into and raised out of, here with such section removed to depict the created opening.
Figure 6:
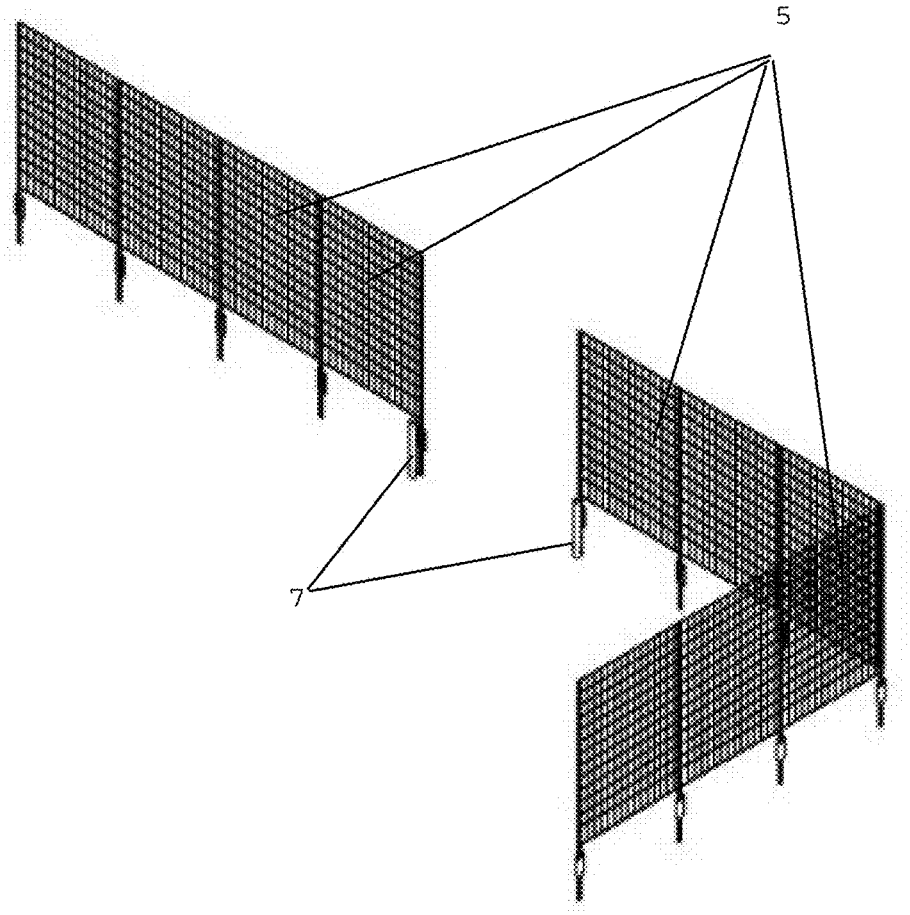
FIG. 6 depicts a typical wire fence with fence sections (5) and periodic posts, two of which, according to embodiments of this disclosure, have been modified to create a removable and replaceable opening with ground anchors (7) that the fence posts can be lowered into and raised out of, here with such section removed to depict the created opening, here with a corner in a perspective view.

In one embodiment, PVC of various diameters and/or metal tubes or a combination is required and post cement is required. Referring to FIG. 1A, in one embodiment, a fence section is depicted wherein a removable section is installed. In this embodiment, there exists either one continuous fence, or a fence with an opening. Referring to FIG. 1A, in this embodiment, a fence post anchor is configured by digging a fence post hole to a predetermined depth, filling the hole with prepared post cement or other appropriate anchoring material and inserting into the anchoring material a configured rotating capsule hollow fashioned in one instance with PVC tubing or metal tubing of a predetermined inside and outside diameter (for example, with a 2" inside diameter hollow) and a bottom cap to prevent the cement or other anchoring material from entering the hollow component. In this embodiment, the fence posts are configured to be slightly less in diameter than the inside diameter of the hollow component (i.e., less than 2" in outside diameter) to slip into the rotating capsule hollows and are thus, capable of raising or lowering, but when inserted, are stable. In an alternative embodiment, the original metal fence posts are anchored into the fence post anchors with their 'ears' or other stabilizing component embedded in the cement or other appropriate anchoring material. In this embodiment, the fence material is attached to PVC tubing of predetermined inside and outside diameters, sufficiently strong to support the fence material and also configured to slip over, on and off of the original metal fence posts.

Figure 7:
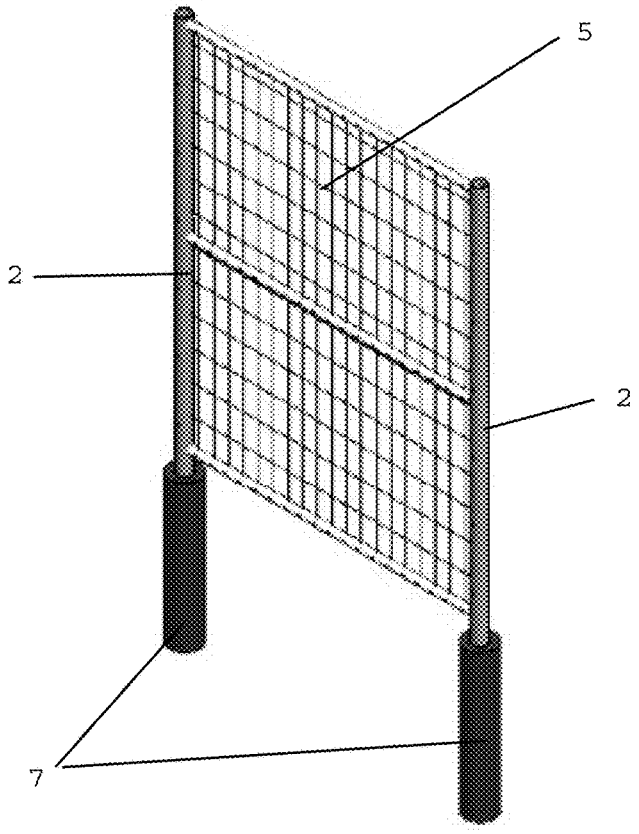
FIG. 7 depicts a fence section (5) according to embodiments of this disclosure wherein the fence section with fence posts (2) is configured to lift out vertically from the post anchors (7) on both sides of the fence section.
Figure 8:
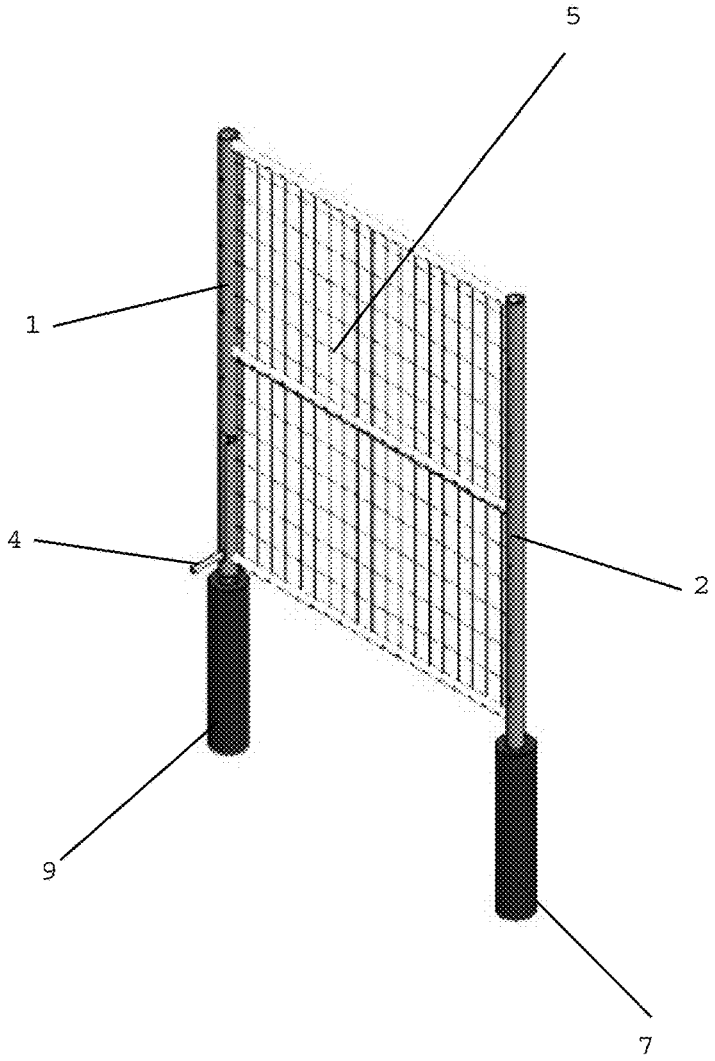
FIG. 8 depicts a fence section (5) according to embodiments of this disclosure wherein a lever (4) is configured to allow a modified fence post (1) on one side of the fence section to come unattached from a configured fence post anchor (9) at ground level, while the opposite fence post (2) can either pull completely out of its corresponding post anchor (7) or rotate within in it (via a rotating capsule hollow contained within it—not shown in this figure).

In an alternate embodiment, referring to FIG. 7, the installation is exactly as just described, except that one fence post is further modified and configured to contain a lever that raises or lowers a pin into or out of the fence post anchor and/or rotating capsule hollow. In this embodiment, when the pin is raised, the fence post section is free to rotate about the other fence post within its corresponding rotating capsule hollow and can rotate open to any degree or closed. A mechanism may be implemented about the rotating fence post to limit the swing to one open direction or to any desired degree of opening. When closed, the lever can reinsert into the rotating capsule hollow of that fence post anchor preventing rotation.

Figure 12:
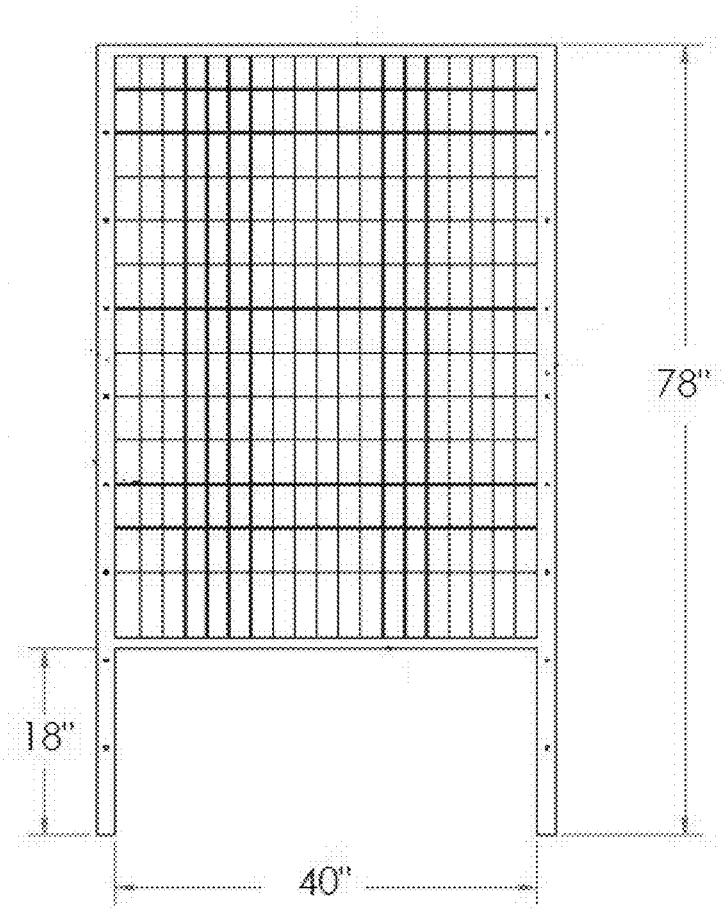
FIG. 12 illustrates certain preferred dimensions of an embodiment of a typical fence section as described herein.

In an alternate embodiment, referring to FIG. 12, two consecutive fence sections are installed as described in the preceding paragraph with the fence posts containing the levers of each fence section configured to be adjacent. In this embodiment, a double door is formed.

Figure 10:
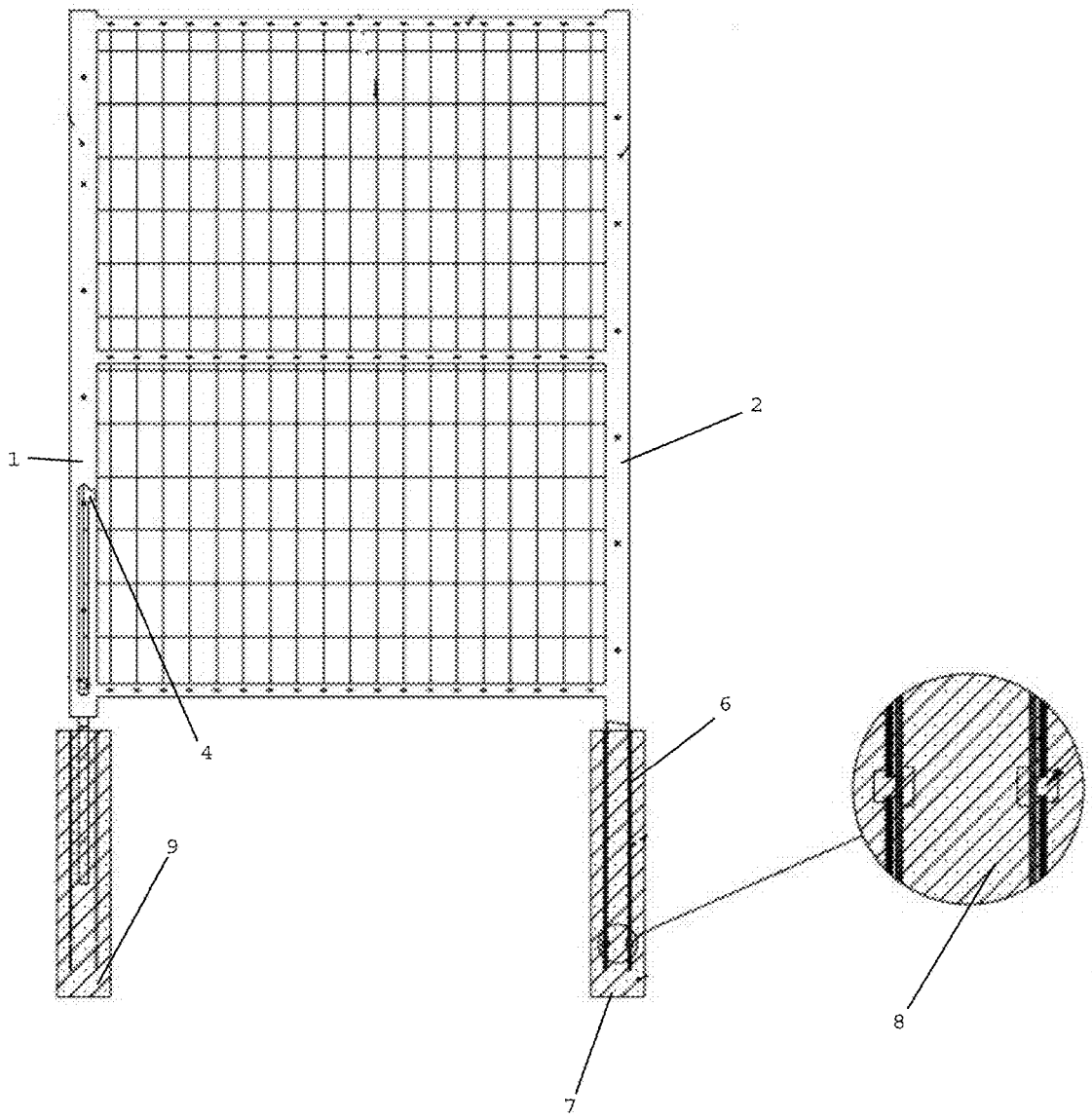
FIG. 10 depicts a fence section modified according to embodiments of the current disclosure whereby the fence section is capable of rotating open and closed as a door on a hinge, showing a modified fence post (1) containing a lever (4) that is configured to unlatch from the post ground anchor (9); a second opposite modified fence post (2) that is configured to rotate within its ground anchor (7) inside a rotating capsule hollow (6). Further depicted is a component of the ground anchors that are embedded in the post cement (8) to prevent the anchor itself from rotation.
Figure 11:
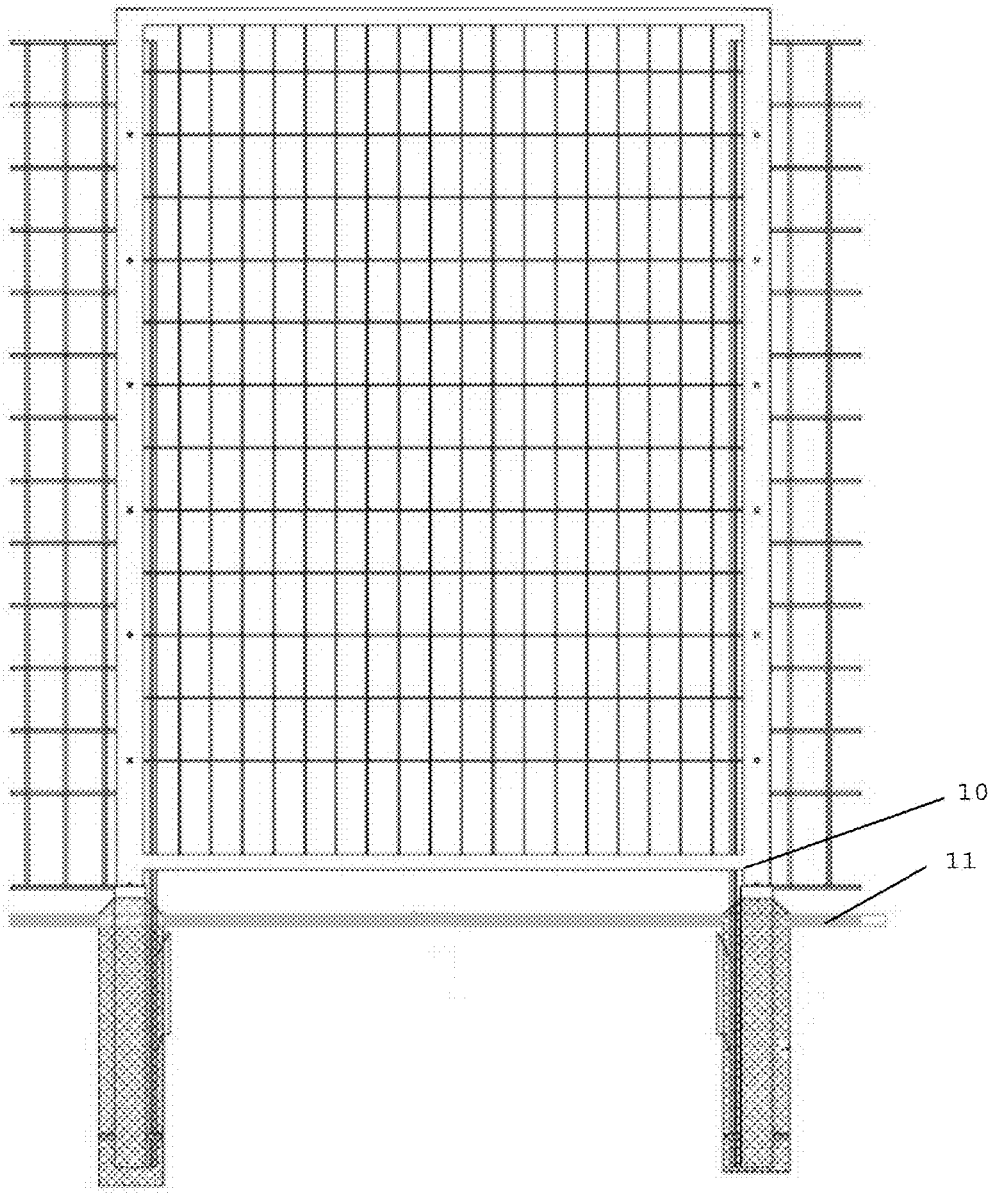
FIG. 11 depicts an embodiment of a typical fence section of a typical wire yard fence with fence posts on either side, fence top and bottom that contain the wire fence section and fence post component that embed into the ground in ground anchors with typical dimensions according to certain embodiments described herein with the fence post sections embedded into the ground anchors such that the bottom of the fence section (10) is just above ground level (11).
Figure 13:
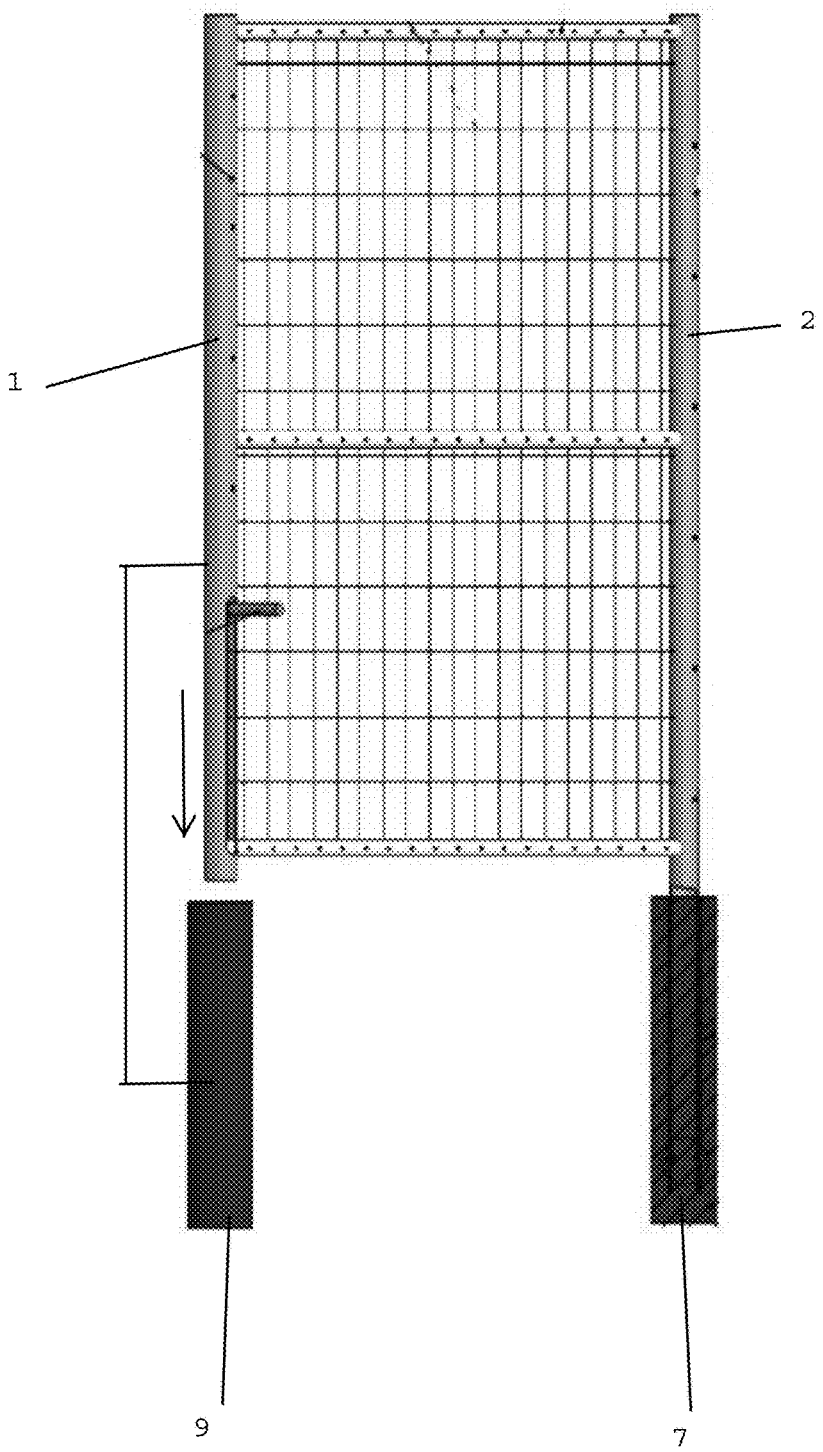
FIG. 13 depicts an embodiment of a fence section configured as a single door opening with a lever (4) on a configured fence post (1) that can raise into or out of a configured fence post anchor (9) to allow door swing on its other fence post (2) that can rotate within its fence post anchor (7) in a head on view.
Figure 14:
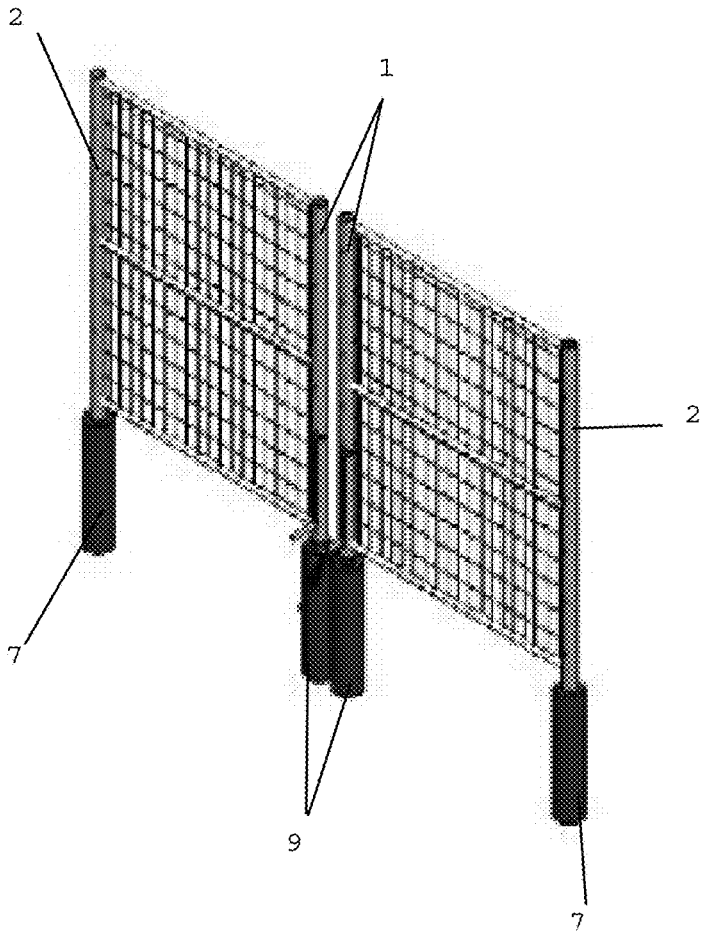
FIG. 14 depicts an embodiment of double door fence sections as described herein in a closed position with the levers (4) in posts (1) latched at ground level within their fence post anchors (9) and opposite posts (2) in their corresponding opposite fence post anchors (7).
Figure 15:
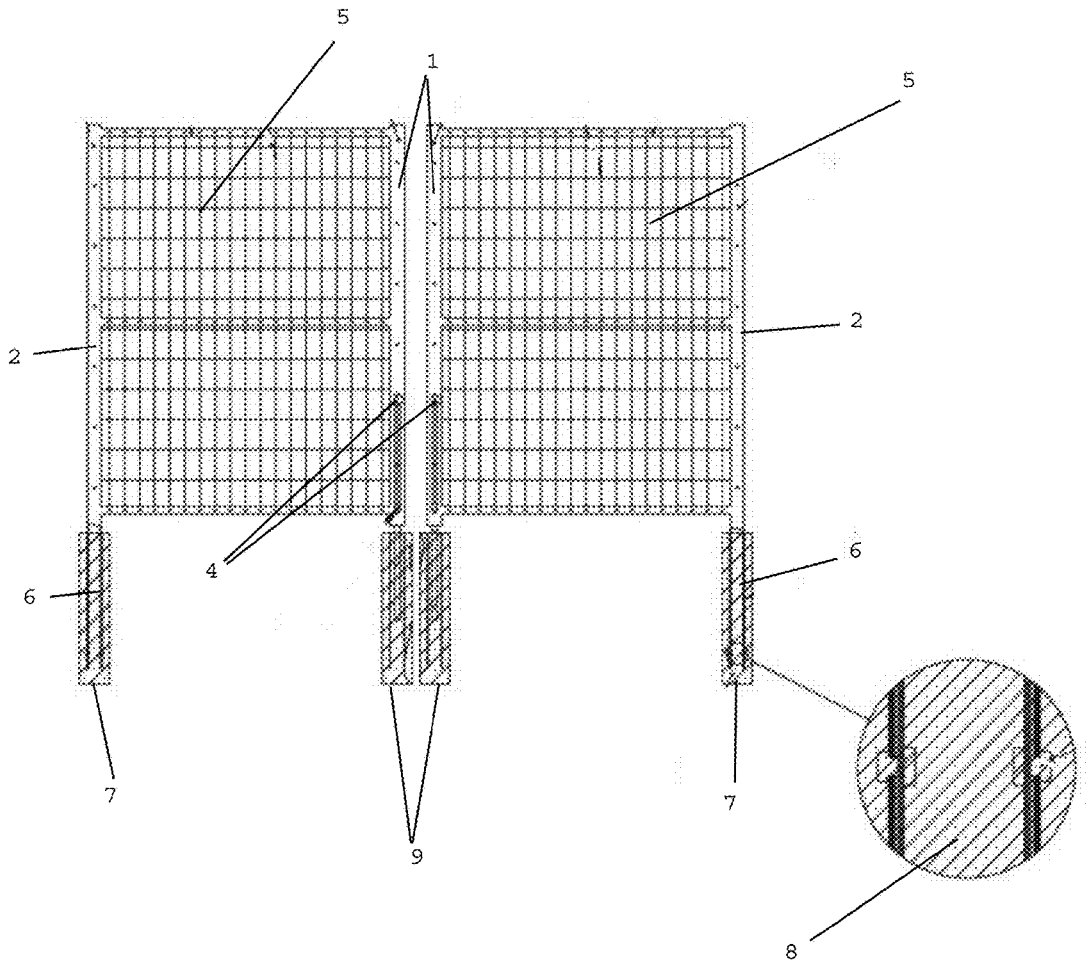
FIG. 15 depicts two consecutive fence sections (5) each modified according to embodiments of the current disclosure whereby each fence section is capable of rotating open and closed as a door on a hinge, showing two modified fence posts (1) each containing a lever (4) that is configured to unlatch from the post ground anchor (9) wherein the two such fence posts are the ones that are next to each other in the consecutive fence sections (i.e., they would be a common fence section post but for the modifications taught herein); and two second modified fence posts (2) corresponding to the opposite fence posts of the consecutive fence sections that are configured to rotate within their ground anchors (7) inside a rotating capsule hollow (6). Further depicted is a component of the ground anchors (8) that are embedded in the post cement to prevent the anchor itself from rotation.
Figure 16:
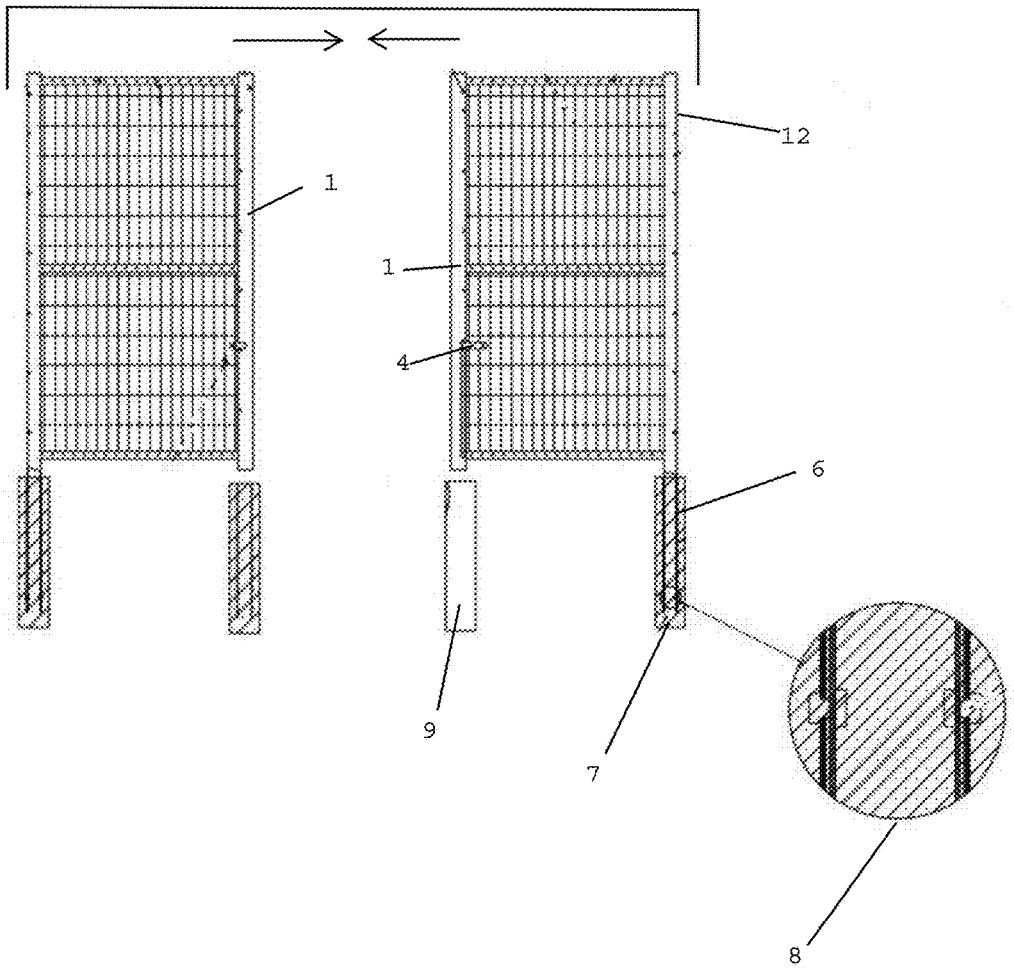
FIG. 16 depicts a head on view of an embodiment of double fence door openings with levers (4) in modified fence posts (1) to allow door swing as described herein on opposite posts (2) within fence post anchors (7) containing rotating capsule hollows (6). The fence sections are shown separated for ease of view, but are actually juxtaposed next to each other as shown by the brackets and arrows. Also shown is all fence posts encased in an outer covering (12) that may be interchangeable as described elsewhere herein to change the overall look and feel of the fence posts when viewed with the naked eye.

Referring to FIGS. 10B and 13B, a perspective view of the swing of the opening fence doors is shown.

EXAMPLES

The present invention is further illustrated, but not limited by, the following examples.

A typical installation as taught herein will be desired by pet owners who want to keep their pets confined to a particular area, but also easily allow the pet and the pet owner in or out when desired. Alternatively, the same configuration may be desired by parents with young children.

Commercially available metal mesh fences with metal fence posts are easily and relatively inexpensively obtainable. However, adding doors and/or gates can easily make the installation more expensive and more technically difficult. By implementing the teachings of this disclosure, no other complicated materials are required or special fence sections purchased, only commonly available PVC and post anchor cement.

Figure 9:
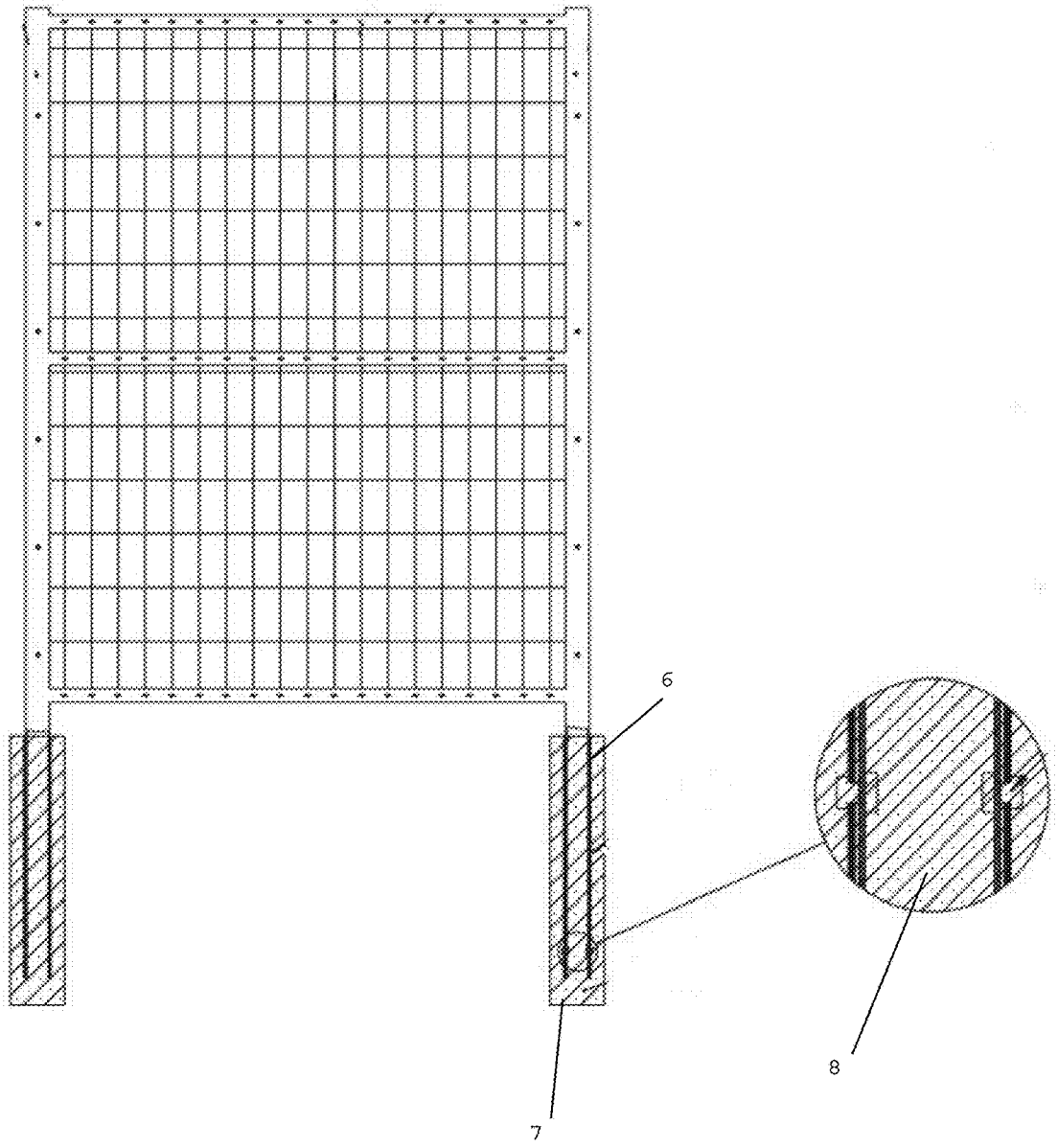
FIG. 9 depicts a fence section modified according to alternative embodiments of the current disclosure wherein the fence section is configured to lift out of the ground anchors (7) and the rotating capsule hollow (6) that exists on the fence posts on both sides of the fence section, but the ground anchor is embedded in the post cement (8) to prevent the anchor itself from rotation.

Referring to FIG. 9, a typical fence section may be 40 inches wide, 60 inches tall with fence posts installed 18 inches into the ground. In one embodiment, a 2 inch diameter steel, PVC or other appropriate material tubing cut into an 18 inch length will form an appropriate fence post anchor. First, dig a hole of 18 inches in depth and insert the cut piece of tubing. Next, create an appropriate rotating capsule hollow by utilizing a 1 inch diameter tubing of similarly appropriate material cut into a 10 inch length and cap one end. Pour prepared concrete mix into the fence post anchor tubing and insert the rotating capsule hollow into the wet cement and allow to set. In this embodiment, an appropriate fence post anchor has been fashioned.

In one embodiment, referring back to FIG. 7, if the lever is further configured to allow the operator to choose whether: (a) the lever simply slides out of its corresponding fence post component configured to allow that fence post component to remain in its corresponding rotating capsule hollow and allow separation; or (b) the lever may remain operatively connected to its corresponding fence post component to act as one piece to allow the operator to choose whether to open the door as is in that configuration or pull the whole door out, reverse orientation and slide the assembly back in and then allow the door to open in the opposite configuration, i.e., the rotational post is reversed. The lever is configured to act as a lever or as a one piece unit operatively connected to the levered post at the choosing of the user.

In one embodiment, all of the posts as described herein can be configured to accept a changeable outer covering. For example, a split plastic tube with cutouts in strategic areas that would otherwise be obstructed can be slipped over the outer post to change the outward appearance of the post to be displayed in any color or finish appearance. Thus, the fence system could appear to have posts of marble or slate or gold or silver or any desired appearance.

In one embodiment, installation advice and/or fence configuration could be offered and/or rendered through a smart device application. For example, an app would be enabled and a passcode given to a purchaser of a system as described herein wherein the user could input dimensions of a yard or desired covered area by a fence with height of fence, distance between fence posts, i.e., width of fence sections, colors and other required and desirable information and the app will calculate the necessary fence system components to achieve the desired configuration and end result and further produce an order to be accepted and further provide installation instructions.

Publications cited throughout this document are hereby incorporated by reference in their entirety. Although the various aspects of the invention have been illustrated above by reference to examples and preferred embodiments, it will be appreciated that the scope of the invention is defined not by the foregoing description but by the following claims properly construed under principles of patent law.

Each and every feature described herein, and each and every combination of two or more of such features, is included within the scope of the present invention provided that the features included in such a combination are not mutually exclusive.

What is claimed is:

1. A fence section installation apparatus comprising, a first fence post anchor with a rotating capsule hollow; a second fence post anchor with a second rotating capsule hollow; a first and second fence post each configured to raise and lower into the corresponding first and second rotating capsule hollows; wherein one of the first or second fence posts comprises an upper section and a lower section and further comprises a lever in said upper section configured to allow just the lever to disengage and raise in and out of said lever and upper section's corresponding lower section configured to raise and lower into said lower section's corresponding first or second rotating capsule hollow.

2. The fence section installation apparatus of claim 1 wherein two consecutive fence sections are each configured such that one of the first or second fence posts of each said fence section comprising an upper and lower section further comprises a lever configured to allow just the lever to disengage and raise in and out of said lever and upper section's corresponding lower section configured to raise and lower into said lower section's corresponding first or second rotating capsule hollow and wherein both said further configured fence posts are adjacent to each other.

3. A complete fence comprising at least three or more fence sections wherein at least one said fence section comprises the fence section installation apparatus of claim 1.

4. The complete fence of claim 3, wherein said fence is fashioned from materials chosen from the group consisting of steel, PVC, wood and plastics.

5. The complete fence of claim 3, wherein said fence is further configured to allow fence posts to accept properly configured outer coverings wherein said fence post contains an outer covering and said coverings are interchangeable.

6. The fence section installation apparatus of claim 1, wherein said apparatus is fashioned from materials chosen from the group consisting of steel, PVC, wood and plastics.

7. The fence section installation apparatus of claim 1, wherein said lever is further configured to engage said fence post lower section within said corresponding rotating capsule hollow and remain operatively connected as one piece and configured to disengage said upper section and lower section as one piece from the rotating capsule hollow and to allow just the lever to raise out of said lever's corresponding post lower section at the choice of the operator.

* * * * *